US005259127A

United States Patent [19]

Pallatin

[11] Patent Number: 5,259,127

[45] Date of Patent: Nov. 9, 1993

[54] DEVICE FOR ADJUSTING THE ADVANCE OF A SKI BOOT

[75] Inventor: Pascal Pallatin, Seynod, France

[73] Assignee: Salomon S.A., Annecy Cedex, France

[21] Appl. No.: 936,009

[22] Filed: Aug. 27, 1992

[30] Foreign Application Priority Data

Sep. 4, 1991 [FR] France ..... 91 11169

[51] Int. Cl.[5] ..... A43B 5/04

[52] U.S. Cl. ..... 36/117; 36/120; 36/121

[58] Field of Search ..... 36/117, 118, 119, 120, 36/121, 50.5

[56] References Cited

U.S. PATENT DOCUMENTS

| | | | |
|---|---|---|---|
| 3,722,112 | 3/1973 | Morgan | 36/121 |
| 3,975,838 | 8/1976 | Martin | 36/50.5 |
| 4,104,811 | 8/1978 | Salomon | 36/121 |
| 4,281,468 | 8/1981 | Giese et al. | 36/50.5 |
| 4,372,061 | 2/1983 | Pozzobon | 36/50.5 |
| 4,406,073 | 9/1983 | Spademan | 36/119 |
| 4,408,403 | 10/1983 | Martin | 36/54 |
| 4,561,196 | 12/1985 | Petrini et al. | 36/118 |
| 4,580,357 | 4/1986 | Martin | 36/119 |
| 4,599,813 | 7/1986 | Sartor | 36/117 |
| 4,601,118 | 7/1986 | Zanatta | 36/121 |
| 4,733,484 | 3/1988 | Delery | 36/120 |
| 5,031,341 | 7/1991 | Paris et al. | 36/120 |

FOREIGN PATENT DOCUMENTS

| | | | |
|---|---|---|---|
| 0205127 | 12/1986 | European Pat. Off. | 36/117 |
| 2024700 | 8/1970 | France . | |
| 2276850 | 1/1976 | France . | |
| 2506135 | 7/1984 | France . | |
| 2652240 | 3/1991 | France . | |

*Primary Examiner*—Steven N. Meyers
*Assistant Examiner*—M. D. Patterson
*Attorney, Agent, or Firm*—Sandler, Greenblum & Bernstein

[57] ABSTRACT

An alpine ski boot including a shell base adapted to encircle tn foot, and an upper overlying the shell base adapted to envelop the lower part of the leg of the skier and at the same time enable the leg of the skier to be flexed at least partially frontwardly, wherein the upper of the boot comprises a rear spoiler pivotally mounted on the shell base by means of a first journal at the level of the heel wall and a front portion, itself constituted by a front tongue cooperating with a front overlapping strap pivotally mounted on the shell base by a second journal, whereas the tightening and closure device of the upper are located respectively on the rear spoiler and the front overlapping strap in order to enable them to cooperate together in the closure position of the boot, a device for adjusting the angle of advance of the upper being located between the front tongue and the overlapping strap in a zone located on the front of the upper.

17 Claims, 4 Drawing Sheets

DEVICE FOR ADJUSTING THE ADVANCE OF A SKI BOOT

BACKGROUND OF THE INVENTION

1. Field of the Invention

The invention is related to a ski boot, and more specifically to a device for adjusting the advance or forward movement of the upper thereof. The present invention is especially related to an alpine ski boot that includes a rigid shell base adapted to surround the foot and an upper overlying the shell base, adapted to surround and envelop the lower part of the leg of a skier and, at the same time, enabling him or her to flex the leg at least partially forwardly when subject to thrusts originating during skiing.

This ski boot that can be of the central-entry type, that is, by simultaneous separation towards the front and towards the rear of two portions of the upper, or of the rear-entry type having, as per the invention, a device for adjusting the angle of advance of the upper with respect to the shell base of the boot in the position of use.

2. Description of Background and Material Information

Currently, there are alpine ski boots on the market that comprise such adjustment devices adapted to ensure, with the required technicity, the transmission of forces applied by the leg of the skier in the area of the upper, in accordance with the ski technique practiced, with the morphology of the skier, and even with the type of terrain. Indeed, to enable skiers to use such boots in different alpine ski disciplines, such as competitive skiing, skiing outside the run, etc., it is desirable, and sometimes even necessary, to be able to vary the angle of front inclination or the angle of advance of these boots.

Such boots have been described in French Patent Publication Nos. 2,024,700 and 2,276,850, for example. However, although these boots enable a variation in the angle of advance, in the majority of cases they are uncomfortable insofar as tibial support for the leg of the skier is concerned during front flexion exercised during skiing. This discomfort is provoked by the constructional arrangement of the devices used, and is reinforced by the fact that its manipulation is awkward, especially when the skier has the boot on, and is obliged to undo it and modify all the closure and tightening adjustments.

Thus, the boot according to French Patent Publication No. 2,024,700 comprises an adjustment device that enables a modification of the angle of advance to be obtained by modifying the grip position, on the upper front portion of a rigid shell base, of the relatively flexible wings of a rear spoiler journalled on such shell base. With this boot, front flexion is permitted basically at an area of a front tongue mounted at a journal on the shell base, and control of this flexion can only be obtained by the cooperation of the flexible wings, by friction and lateral separation, the tongue being in support against such wings. In this specific case, the adjustment of the angle of advance of the upper only produces really substantial effects when there is rear support of the leg because the flexible wings open during forward separation.

As regards the ski boot according to French Patent Publication No. 2,276,850, the adjustment of the advance is obtained by modifying the length of the perimeter of the front enveloping of the lower part of the leg by the upper. This upper in fact originates from the shell base that rises towards the tibial support zone by forming a front portion provided with a median slot that ends in a hole. This front portion of the shell-upper is covered by a strap journalled laterally on the shell that extends towards the rear to ensure, by means of hooks, the closure of the upper. The adjustment of the angle of advance is thus obtained by insertion of a wedge, shaped like an inverted key hole, in the slot and the hole whose edges it separates, such that the periphery of the upper is modified. After such modification, by the tightening of the strap on the upper, which is displaced according to the value of the size of the wedge, the angle of advance of such upper is also modified. In this example, it is thus necessary to have available several wedges having different sizes to obtain a progressive variation of the angle of advance. Additionally, the positioning of this wedge beneath the covering strap is awkward because the material of the upper shell is relatively rigid and can only be separated with difficulty.

SUMMARY OF THE INVENTION

An object of the present invention is to overcome the disadvantages mentioned hereinabove, and to obtain a ski boot provided with a device for adjusting the angle of advance of the upper, having simple manipulation and construction, and at the same time eliminating all interference with the flexion control means or with the tightening and closure means of the upper.

To this end, the ski boot according to the present invention includes a shell base adapted to encircle the foot of the skier and an upper overlying the shell base adapted to envelop the lower part of the leg of the skier, and at the same time enabling the skier to flex at least partially forwardly. The upper of the boot includes a rear spoiler pivotally mounted on the shell base by virtue of a first journal axis at the area of the heel wall, and by a front portion, itself constituted by a front tongue cooperating with a front overlapping strap, pivotally mounted on the shell base by virtue of a second journal axis, whereas the tightening and closure means of the upper are located respectively on the rear spoiler and front overlapping strap, so that they cooperate together in the use position, a device for adjusting the angle of advance of the upper being located between the front tongue and the front overlapping strap in a zone located on the front of the upper.

Several embodiments can be proposed within the scope of the present invention, including a ski boot whose upper, journalled with respect to the shell base, is of the rear-entry type.

According to another embodiment, the ski boot is of the central-entry type for the upper, in at least two distinct portions, which enables insertion of the foot within the boot by separation in the longitudinal axis of the boot, of each of these portions of the upper.

Further, various adjustment devices can be provided between the front tongue and the front overlapping strap, without these structures being beyond the scope of the invention.

BRIEF DESCRIPTION OF THE DRAWINGS

Other characteristics and advantages of the invention will become more apparent upon reading the description that follows with reference to the annexed drawings provided as non-limiting examples only.

DETAILED DESCRIPTION OF THE PREFERRED EMBODIMENTS

Figure 1:
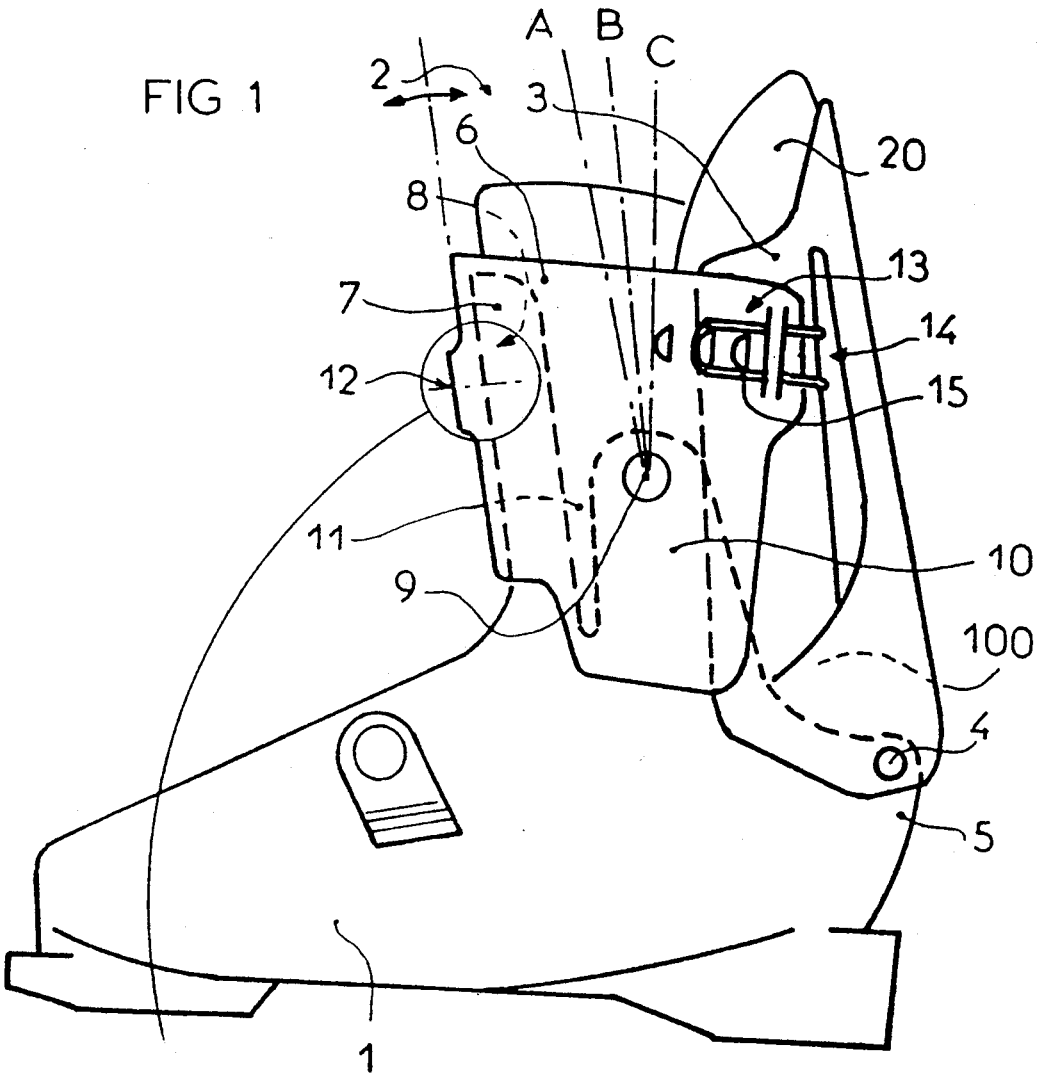
FIG. 1 represents a lateral view of a ski boot according to the invention, in which the boot is of the rear-entry type comprising a front tongue extending from the shell base with which it is unitarily formed.

Other objects and characteristics of the present invention will become apparent upon reading the detailed description with reference to the embodiment illustrated in FIG. 1, where the ski boot according to the invention includes a shell base (1) on which an upper (2) is mounted with at least a partial journal, such upper encircling the lower part of the leg of a skier. The upper itself includes a rear spoiler (3) mounted on a journal (4) located in the area of the heel wall (5) of the shell base, and a front overlapping strap (6) including a front tongue (7) originating from the shell base (1) with which it is integral.

The front tongue (7) extends along the front of the boot so as to rise along the front portion of the foot and of the lower part of the leg of the skier and thus constitutes a contact surface (8) for the tibial support of the skier. The front overlapping strap (6) is journalled, as for it, on each side of the shell on two rivets (9) defining its pivot axis and located preferably at the upper end of each of the two lateral wings (10) extending the shell base upwardly approximately along the axis of the leg. The two lateral wings (10) thus cover the lateral zones of the ankle of the skier and fulfill the function of a device resisting flexion of the upper exerted by the skier during use.

Between the front tongue (7) and each of the lateral wings (10), a scallop (11) of the shell base determines the independence of each of these shell portions that contribute at least partially to the formation of the elements of the upper. The latter element is thus wholly obtained by the positioning, between the front tongue (7) and the front overlapping strap (6), of a device for adjusting the advance (12), whereas the tightening and closure means (13) such as buckle hooks, or other known means, ensure the connection between the rear spoiler (3) and front overlapping strap (6).

The pivot axis (4) of the rear spoiler (3) and those (9) of the front overlapping strap (6) are located, as illustrated as an example, at different heights along the upper. Thus, the journal axis (9) of front overlapping strap (6) is located more in front and higher than the axis (4) of rear spoiler (3). A sliding opening (14) of buckle (15) of the closure hook is provided, arranged on the rear face of said rear spoiler (3). Thus, during flexional movements, the direction of the tractional forces on the buckle remains constant due to the freedom of movement of the buckle along the sliding opening, and this ensures that each of the gripping or attachment portions of the tightening and closure means, located respectively on front overlapping strap (6), and on rear spoiler (3) remains aligned opposite each other. This relative change of position between front tongue (7) and front overlapping strap (6) results in the variation of the angular position with respect to the shell base. Consequently, when the rear spoiler (3) is in a closed position on front overlapping strap (6), the entirety of the upper (2) is subject to this angular variation.

The device for adjusting the advance (12) located on the front surface of the upper (2) connects, in a fixed manner, although vertically adjustable in position, front overlapping strap (6) to front tongue (7), thus allowing a relative change of position between these two elements of the upper.

Figure 3:
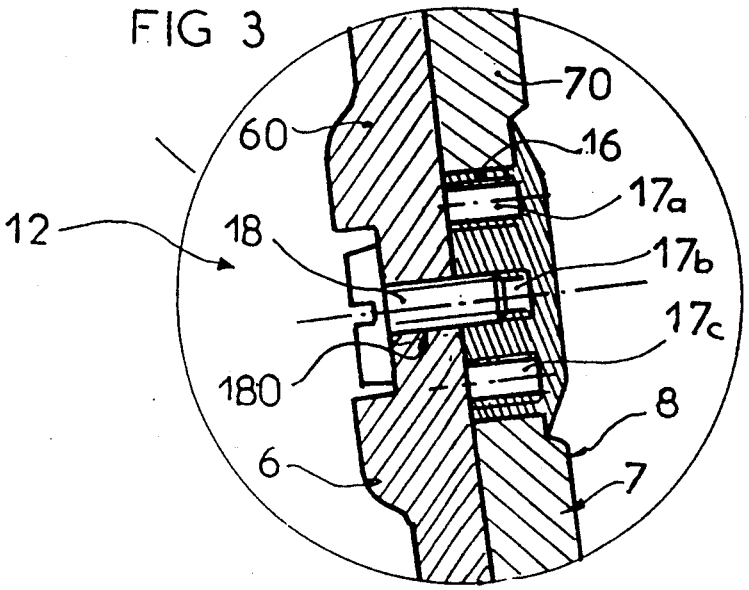
FIG. 3 is a sectional view of a device for adjusting the advance adapted to any one of the boots illustrated previously.

FIG. 3 illustrates such a device for adjusting the advance (12), having a simple and reliable construction. Incidentally, it is an insert (16) advantageously embedded along the median axis of the boot and in the upper zone of the wall (70) of the front tongue (7) and comprising at least two threaded holes (17*a*, 17*b*, 17*c*), located vertically one beneath the other.

The insert (16) is represented as an example and comprises three threaded holes (17*a*, 17*b*, 17*c*) placed one beneath the other to define three stop positions. In the wall (60) of the front overlapping strap (6) another hole (180) is thus arranged, through which is engaged a screw (18) adapted to cooperate with one of the threaded holes of the insert. Naturally, this screw is also implanted on the median axis of the boot, such that adjustment along one of the vertical positions of the holes can be easily undertaken. Thus, for each of the positions of the threaded holes, there is a given corresponding angle of advance of the upper (2). For the lowest position of the hole (17*c*), there is a corresponding position "A" higher than the position of advance "B" defined by the cooperation of the screw (18) with the median hole (17*b*), which is itself higher than the position of advance "C" defined by the cooperation of screw (18) with the top-most hole (17*a*).

Additionally, by virtue of the journal axis (9) of a front overlapping strap (6) on shell (1) and by virtue of the lateral scallops (11) of the shell, the independence of the flexion control means, obtained by the lateral wings (10) is ensured, whatever the angular position selected.

Figure 2:
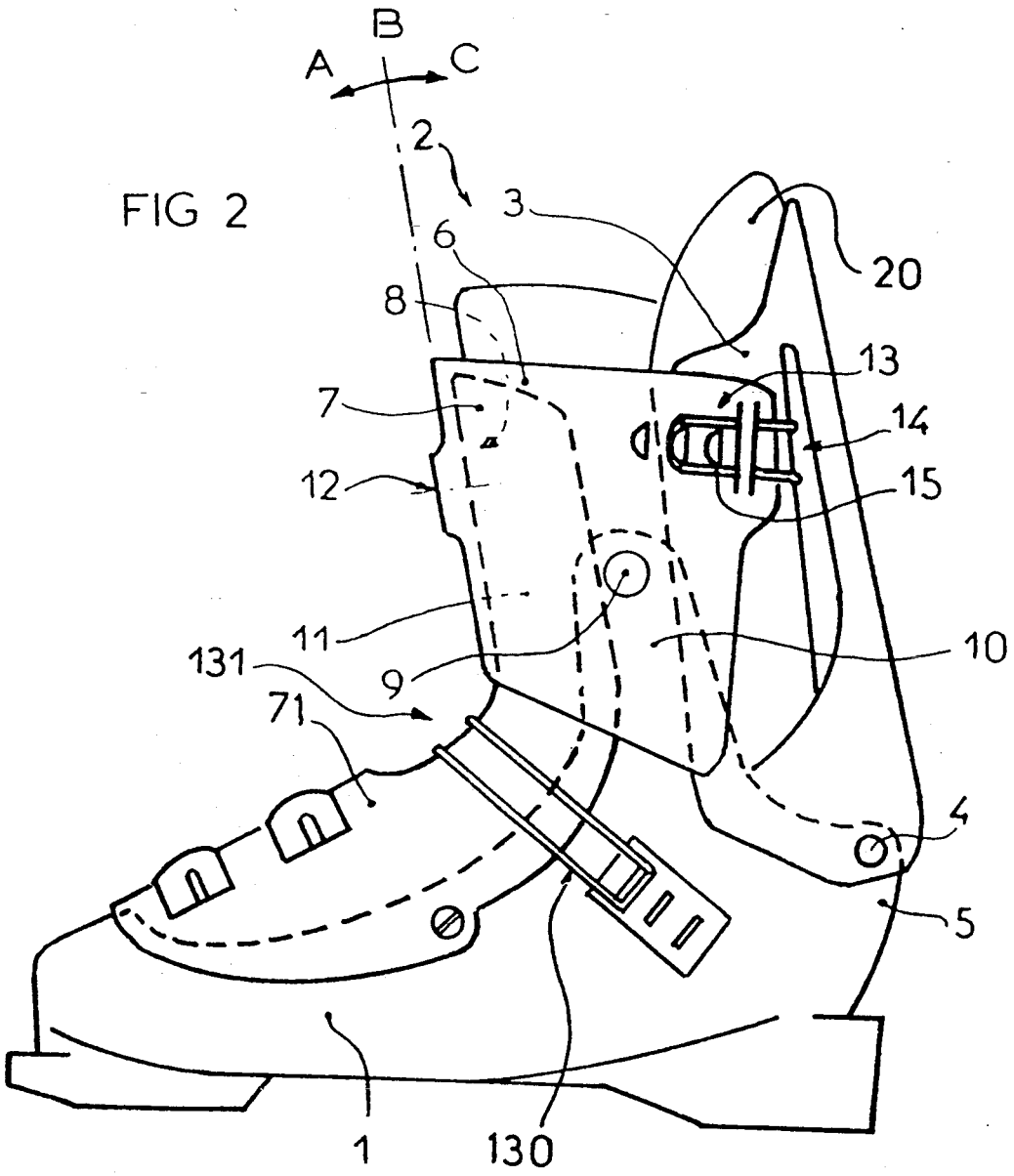
FIG. 2 illustrates another embodiment of the ski boot according to the invention, in which the boot is of the central-entry type and whose upper includes several portions assembled and combined to each other.

Further, the invention is perfectly transposable to a boot of the central-entry type, such as illustrated in FIG. 2. For clarity of description, the elements of this boot that are common to those of the boot described in FIG. 1 will be designated by the same reference numerals.

Indeed, in this embodiment, front tongue (7) originating from the rigid shell base (1) has been replaced by a closure spoiler or front cuff (71) covering the front opening zone of the shell of the boot. This closure or front spoiler (71) extends upwardly by means of a front tongue (7), for example, more flexible than its lower zone. The front tongue (7) thus comes into cooperation, as described for the boot according to FIG. 1, with a front overlapping strap (6) journalled on the lateral wings (10) originating from shell base (1). In order to procure a good closure of the spoiler (71) on shell base (1), tightening and closure means (130) in addition to those (13) of the upper portion of the upper are provided, approximately in zone (131) corresponding to the flexion fold of the boot.

In a similar manner to the rear entry boot described hereinabove, a device for adjusting the advance (12) is arranged along the front surface of upper (2), so as to obtain a boot whose combination of different structural means enables it to remain within the scope of the invention whose claims hereinafter will define the protection desired.

In addition, the boot according to the invention can comprise a known lining (20).

Figure 4A:
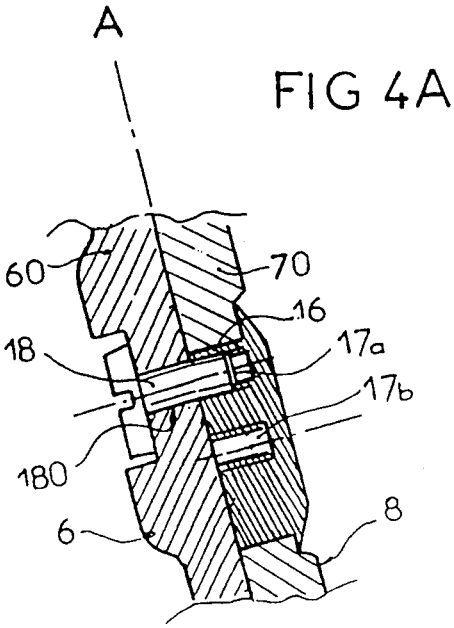
FIGS. 4A, 4B and 4C are views similar to FIG. 3 showing a variation of the adjustment device in its three possible positions A, B, and C.
Figure 4B:
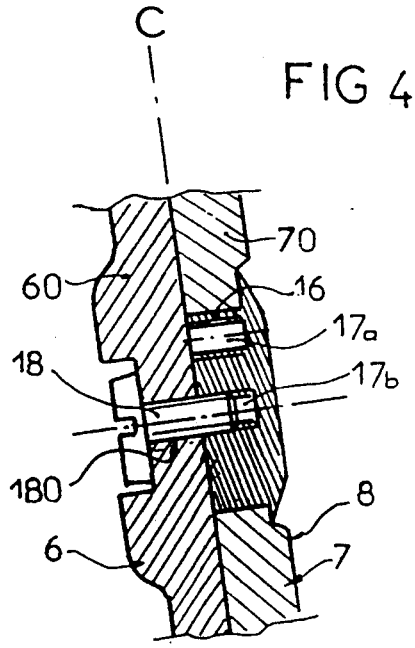
Figure 4C:
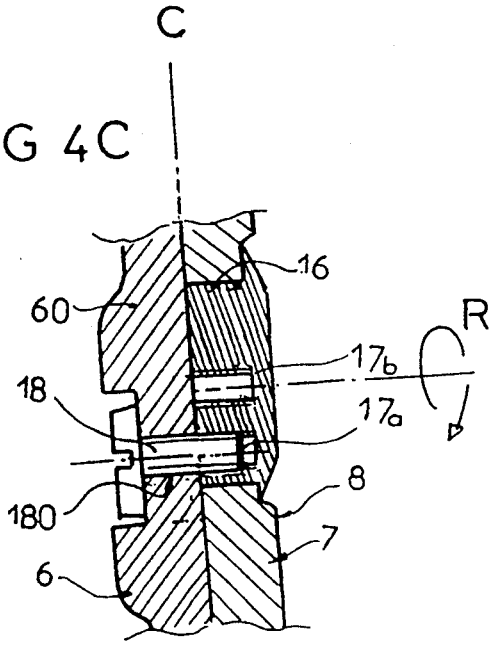

FIGS. 4A, 4B and 4C show a first possible variation of the device for adjusting the advance. According to this embodiment, reversible insert (16) only comprises two threaded holes (17*a*, 17*b*). The first hole (17*b*) being at the center of the insert, whereas the second (17*a*) is off-center.

Thus, by turning the insert in the direction "R" (shown in FIG. 4C), the angle of advance can take the third position "C".

FIG. 4A illustrates the first position "A" and FIG. 4B, the median position "B".

Figure 5A:
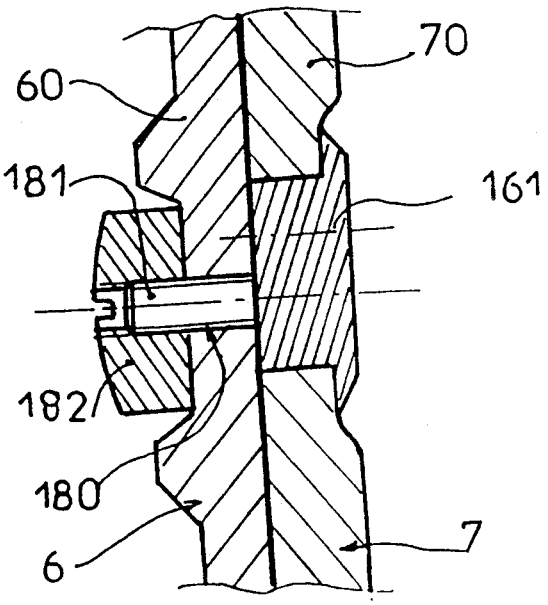
FIGS. 5*a* and 5*b* represent another variation of the adjustment device in its two adjustment positions.
Figure 5B:
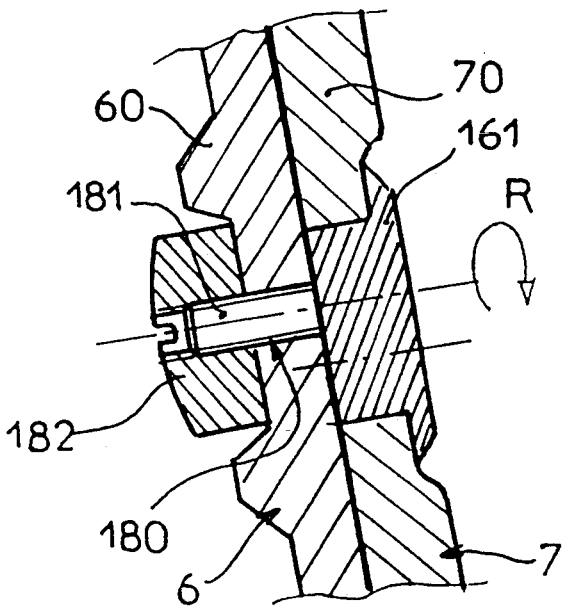

FIGS. 5*a* and 5*b* illustrate a second embodiment of the adjustment device which comprises an insert (161) which is also reversible and which comprises a threaded upper (181) extending frontwardly to cooperate with the hole (180) of the overlapping strap (6), the tightening being obtained by a threaded button (182).

FIG. 5*a* illustrates a first adjustment position in which the upper is in projection (181) and lowered, whereas in FIG. 5*b*, the insert is represented in a second position obtained by upturning it to define the other adjustment position.

Figure 6:
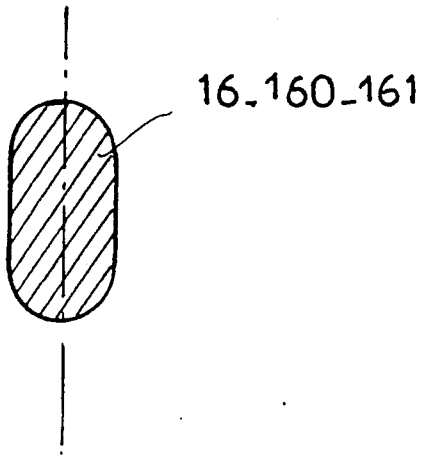
FIG. 6 is a transverse sectional view of an insert.

Advantageously, the inserts have an elongate shape such as represented in FIG. 6, so that they can be blocked in rotation, thus preventing any accidental turning.

The instant application is based upon French patent application 91.11169 of Sep. 4, 1991, the disclosure of which is hereby expressly incorporated by reference thereto, and the priority of which is hereby claimed.

Further, the invention is not limited to the particular embodiments described and represented as examples hereinabove, but also comprises all technical equivalents thereof as well as their combinations.

What is claimed is:

1. An alpine ski boot comprising:

a shell base adapted to encircle the foot;

an upper overlying said shell base adapted to envelop the lower part of the leg of a skier and at the same time enabling the leg of the skier to be flexed at least partially frontwardly, wherein said upper of the boot comprises:

a rear spoiler pivotally mounted on said shell base by means of a first journal in an area of a heel wall;

a front portion, said front portion comprising a front tongue extending upwardly from the shell base and cooperating with a front overlapping strap, said strap being pivotally mounted on the shell base by a second journal, said second journal being located above an ankle area of the skier, said front tongue having a contact surface for tibial support of the skier and being distinct from other shell base portions; and means for tightening and closing said rear spoiler and said front overlapping strap and for ensuring that said rear spoiler and said front overlapping strap cooperate together in a closed position of the boot; and an adjustment device for adjustment of the angle of advance of the upper located between said front tongue and said overlapping strap in a zone located on the front of the upper, said adjustment device further comprising means for fixing said front tongue and said overlapping strap relative to each other in any of a plurality of predetermined positions of advance.

2. A ski boot as defined by claim 1, wherein the front tongue comprises a front vertical extension originating from said shell base with which the front tongue is unitary.

3. A ski boot as defined by claim 1, further comprising a front spoiler attached to said shell base at a front zone of said shell base, wherein the front tongue comprises a vertical extension of said front spoiler.

4. A ski boot as defined by claim 1, wherein the front overlapping strap and the rear spoiler respectively comprise gripping portions for the tightening and closing means of said upper.

5. A ski boot as defined by claim 1, wherein said shell base extends along each of the sides of said shell base by a lateral wing extending upwardly on which the front overlapping strap is journalled about the second journal.

6. A ski boot as defined by claim 5, wherein a scallop of the shell base is located between the front tongue and each of the lateral wings.

7. A ski boot as defined by claim 1, wherein the second journal is located higher than the first journal.

8. A ski boot as defined by claim 1, wherein the device for adjusting the angle of advance is located substantially along the median axis of the boot in the upper zone of the upper.

9. A ski boot as defined by claim 8, wherein the device for adjusting the angle of advance comprises at least two adjustment positions located vertically one beneath the other.

10. A ski boot as defined by claim 1, wherein the device for adjusting the angle of advance comprises an insert having threaded holes arranged vertically, embedded in a wall of the front tongue, and a screw housed in a wall of the overlapping strap for insertion in any one of the threaded holes of the insert.

11. A ski boot movable between an open position, for introducing a skier's leg into the boot, and a closed position, for supporting the skier's leg during skiing, said ski boot comprising:

(a) a shell base for covering the foot of the skier;

(b) an upper overlying the shell base for enveloping the lower part of the leg of a skier, the upper comprising:

(i) a rear spoiler;

(ii) means for pivotally mounting the rear spoiler on the shell base about a first transverse axis in a heel area of the shell base;

(iii) a front portion comprising:

(A) a front tongue extending upwardly from the shell base for supporting a front portion of the tibial area of the skier at least in the closed position of the boot; and (B) a front strap at least partially overlying the front tongue;

(iv) means for pivotally mounting the front strap on the shell base about a second transverse axis, the second transverse axis being positioned above the first transverse axis;

(c) means for maintaining the boot in the closed position and for enabling movement of the front strap and the rear spoiler together with respect to the shell base; and (d) means for affixing a portion of the front strap to a portion of the front tongue in any of a plurality of predetermined positions of advance of the upper with respect to the shell base.

12. A ski boot as defined by claim 11, wherein said means for affixing a portion of the front strap to a portion of the front tongue in any of a plurality of predetermined positions of advance comprises an adjustment device having a removable fastener and a plurality of opening for selectively receiving the removable fastener to thereby define the plurality of predetermined positions of advance.

13. A ski boot as defined by claim 11, wherein the tongue is a unitary portion of the shell base.

14. A ski boot as defined by claim 11, further comprising a front cuff attached to a front portion of the shell base, wherein the front tongue comprises an upward extension of the front cuff.

15. A ski boot as defined by claim 14, further comprising a device for tightening and closing the front cuff with respect to the shell base located in a flexion fold area of the ski boot.

16. A ski boot as defined by claim 11, wherein the means for maintaining the boot in the closed position and for enabling movement of the front strap and the rear spoiler together with respect to the shell base comprises a tightening and closing device extending between respective portions of the rear spoiler and front strap, the tightening and closing device including means affixed to the front strap and slidably displaceable with respect to the rear spoiler during flexion of the upper during skiing.

17. A ski boot as defined by claim 11, wherein the small base includes lateral portions that extend upwardly above the ankle are of the skier.

* * * * *